US005681042A

United States Patent [19]

D'Aurora et al.

[11] Patent Number: 5,681,042

[45] Date of Patent: Oct. 28, 1997

[54] GAME BOARD APPARATUS

[75] Inventors: Joseph R. D'Aurora, Canton, Ohio; David F. Specht, Fairfax, Va.

[73] Assignee: Dream Makers, Inc., Canton, Ohio

[21] Appl. No.: 477,183

[22] Filed: Jun. 7, 1995

[51] Int. Cl.[6] ..... A63F 3/00

[52] U.S. Cl. ..... 273/243; 273/282.2

[58] Field of Search ..... 273/242, 243, 273/248, 249, 246, 239, 273, 282.1, 282.2

[56] References Cited

U.S. PATENT DOCUMENTS

| | | | |
|---|---|---|---|
| 601,383 | 3/1898 | Reuter | 273/282.1 |
| 1,201,100 | 10/1916 | Rice-Wray | 273/282.1 |
| 2,585,924 | 2/1952 | Freedman et al. | 273/282.2 |
| 2,586,017 | 2/1952 | Freedman | 273/282.2 |
| 2,757,933 | 8/1956 | Gilmour | 273/254 |
| 3,235,260 | 2/1966 | Glass et al. | 273/282.2 X |
| 3,416,802 | 12/1968 | Montes | 273/246 |
| 3,734,505 | 5/1973 | Germanis | 273/282.1 X |
| 3,807,739 | 4/1974 | Henley et al. | 273/282.1 X |
| 3,836,151 | 9/1974 | Bowerman | 273/282.2 |
| 3,844,563 | 10/1974 | Isaac | 273/282.1 X |
| 4,496,327 | 1/1985 | Bennett | 273/282.2 X |
| 5,435,566 | 7/1995 | Scuderi | 273/249 X |

FOREIGN PATENT DOCUMENTS

| | | | |
|---|---|---|---|
| 8203473 | 4/1984 | Netherlands | 273/282.2 |
| 594427 | 1/1978 | Switzerland | 273/282.2 |

*Primary Examiner*—William E. Stoll

*Attorney, Agent, or Firm*—Watts, Hoffman, Fisher & Heinke Co., L.P.A.

[57] ABSTRACT

A game board apparatus having multiple sets of playing space designators is disclosed. The playing space designators are adapted to be removably affixed to playing spaces of a playing board. Examples of sets would include professional baseball teams, computer and telecommunications firms, professional football teams, etc. When a set of designators is chosen, the players then affix individual designators to playing spaces on the playing board surface. Each playing space designator includes indicia representing one or more characteristics of the playing space designator.

2 Claims, 4 Drawing Sheets

GAME BOARD APPARATUS

TECHNICAL FIELD

The present invention relates to a game board apparatus and, particularly, a game board apparatus including playing space designators which are removably attachable to the game board.

BACKGROUND ART

Typical game boards have a playing surface which includes a plurality of playing spaces defining one or more routes around the board. Players have gamepieces which are moved between playing spaces as the game progresses. A player moves his or her gamepiece a certain number of playing spaces from its present playing space position in accord with a numerical value generated by a random number generator such as, for example, a pair of dice.

The playing surface is usually printed on the glossy side of heavy gauge paper. The paper, in turn, is adhesively attached to a cardboard backing. The cardboard backing provides rigidity for the playing surface and insures that the surface is substantially planar. The gameboard designer predetermines both the number of playing spaces and a designation of each playing space.

In the game board disclosed in applicants' U.S. Pat. No. 4,466,515 to D'Aurora and Specht entitled Investment Game Board and Apparatus, which is incorporated in its entirety herein by reference, and marketed by KDN Enterprises, Inc. of Canton, Ohio under the name "BIG WHEEL," 24 predetermined playing spaces of the total 40 playing spaces are assigned company names, e.g., United Airlines, Avis, Inc, 3M, etc. Associated with each company is a set of stock market values representing the value of a chair on the board of directors of the company under different economic conditions (normal economy, recession, depression, inflation, super inflation).

Although applicants' BIG WHEEL game has been well received, since the playing space designations are fixed, the players are forced to play with the 24 companies chosen by the game designer and printed on the playing surface. Furthermore, the set of board of director chair values assigned each company are also fixed, that is, the players have no possibility of changing the predetermined positions of the companies on the game board.

Players may wish to play the BIG WHEEL game with, for example, a set of 24 professional baseball teams instead of the 24 companies chosen by the game designer. And, the players may wish to designate different chair values for different teams in successive games played even if the same set of 24 teams are utilized. The present invention permits the players to make modifications to the playing space designations to suit their desires.

SUMMARY OF THE INVENTION

The present invention provides a novel game board apparatus having a playing surface marked with game indicia including a plurality of playing spaces. Each of the playing spaces includes one or more characteristics associated with the playing space. The game board apparatus includes a set of playing space designators, each playing space designator is removably affixable to the game board playing surface and sized to overlie at least a portion of a selected playing space.

Additionally, each playing space designator includes indicia representing one or more characteristics of the playing space designator. A playing space is deemed to have a set of characteristics including the characteristics of a playing space designator affixed to it and one or more characteristics associated with the playing space.

To provide more flexibility, a plurality of sets of playing space designators may be provided. The players first choose a set of playing space designators from the plurality of sets. For example, there may be a set of playing space indicators featuring various major league baseball teams. Each playing space indicator would include the name and logo of a different major league team. Another set of playing space indicators may feature various computer hardware and software manufacturers. Yet another set of playing space indicators may feature professional basketball teams. There may be another set of playing space indicators featuring automobile manufacturers.

Once a set of playing space indicators have been selected by the players, individual indicators are selected and each is affixed to a selected one of the playing spaces. Since the each playing space has different characteristics associated with the space, e.g., the "value" of a company that is affixed to the space, the players have the flexibility to both choose the set of companies they wish and, for individual companies in the selected set, to choose a playing space for the company commensurate with the desired characteristics of that company, i.e., the company's relative value vis-a-vis other companies.

An object of this invention is to provide a game board apparatus which permits the players to choose a set of playing space designators, each designator representing a different business or organization, for playing the game from a plurality of sets of playing space designators.

Another object of this invention is to provide a game board apparatus wherein each playing space has an one or more characteristics associated with the space and the players can selectively assign playing designators to the playing spaces such that a given designator has a desired characteristic or characteristics.

These and other objects, advantages and features of the invention will become better understood form a detailed description of a preferred embodiment which is described in conjunction with the accompanying drawings.

DETAILED DESCRIPTION

Game Board

Figure 1:
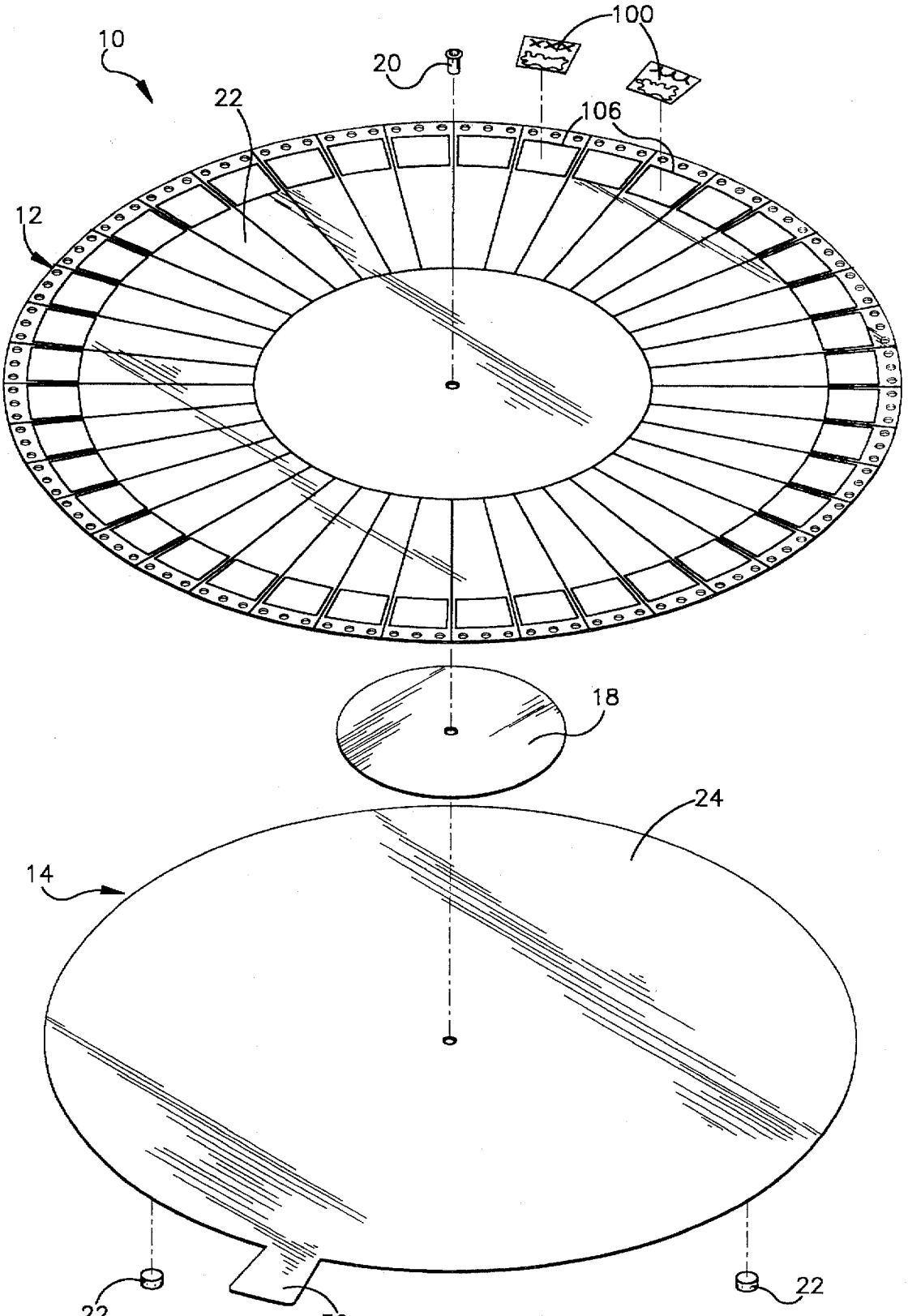
FIG. 1 is an exploded view of a game board and two exemplary playing space designators of the present invention.

Turning to FIG. 1, an exploded view of a game board is shown generally at 10. The game board 10 includes a circular playing board 12 which has a playing surface 14 and an information board 16 which is rotatable with respect to the playing board 12. The information board 14 is circular in shape and has a diameter less than the diameter of the playing board 12. A spacer ring 18 separates the playing board 12 and the information board 16. An eyelet arrangement 20 secures the playing board 12 to the spacer ring 18 and the information board 16. A plurality of support legs 22 are adhesively attached to a bottom surface of the information board to space the game board 10 above a support surface (not shown) such as a table or the like.

The outer periphery of the playing board 12 is divided into 40 playing spaces. The following are designations for the 40 spaces:

| | | | |
|---|---|---|---|
| S1 | Collect Dividend | S21 | Buy or Sell |
| S2 | Company 1 | S22 | Company 13 |
| S3 | Company 2 | S23 | Company 14 |
| S4 | Recession | S24 | Recession |
| S5 | Company 3 | S25 | Company 15 |
| S6 | Federal Tax | S26 | State Tax |
| S7 | Company 4 | S27 | Company 16 |
| S8 | Company 5 | S28 | Company 17 |
| S9 | Normal | S29 | Normal |
| S10 | Company 6 | S30 | Company 18 |
| S11 | Buy or Sell | S31 | Buy or Sell |
| S12 | Company 7 | S32 | Company 19 |
| S13 | Company 8 | S33 | Company 20 |
| S14 | Super Inflation | S34 | Super Inflation |
| S15 | Company 9 | S35 | Company 21 |
| S16 | Depression | S36 | Depression |
| S17 | Company 10 | S37 | Company 22 |
| S18 | Company 11 | S38 | Company 23 |
| S19 | Inflation | S39 | Inflation |
| S20 | Company 12 | S40 | Company 24 |

For clarity of illustration, indicia imprinted on an upper or playing surface 22 of the playing board 12 and an upper surface 24 of the information board are not shown in the drawings. The indicia are shown and game rules explained in detail in the aforementioned '515 patent to D'Aurora et al.

The direction of play of the game is clockwise with a collect dividend space S1 being the starting position. For each of the 40 playing spaces S1–S40, there are three apertures 26 (best seen in FIG. 3) adapted to receive a base peg of a chair gamepiece (not shown) which signifies a player's ownership of stock in a company assigned to that company playing space.

Figure 2:
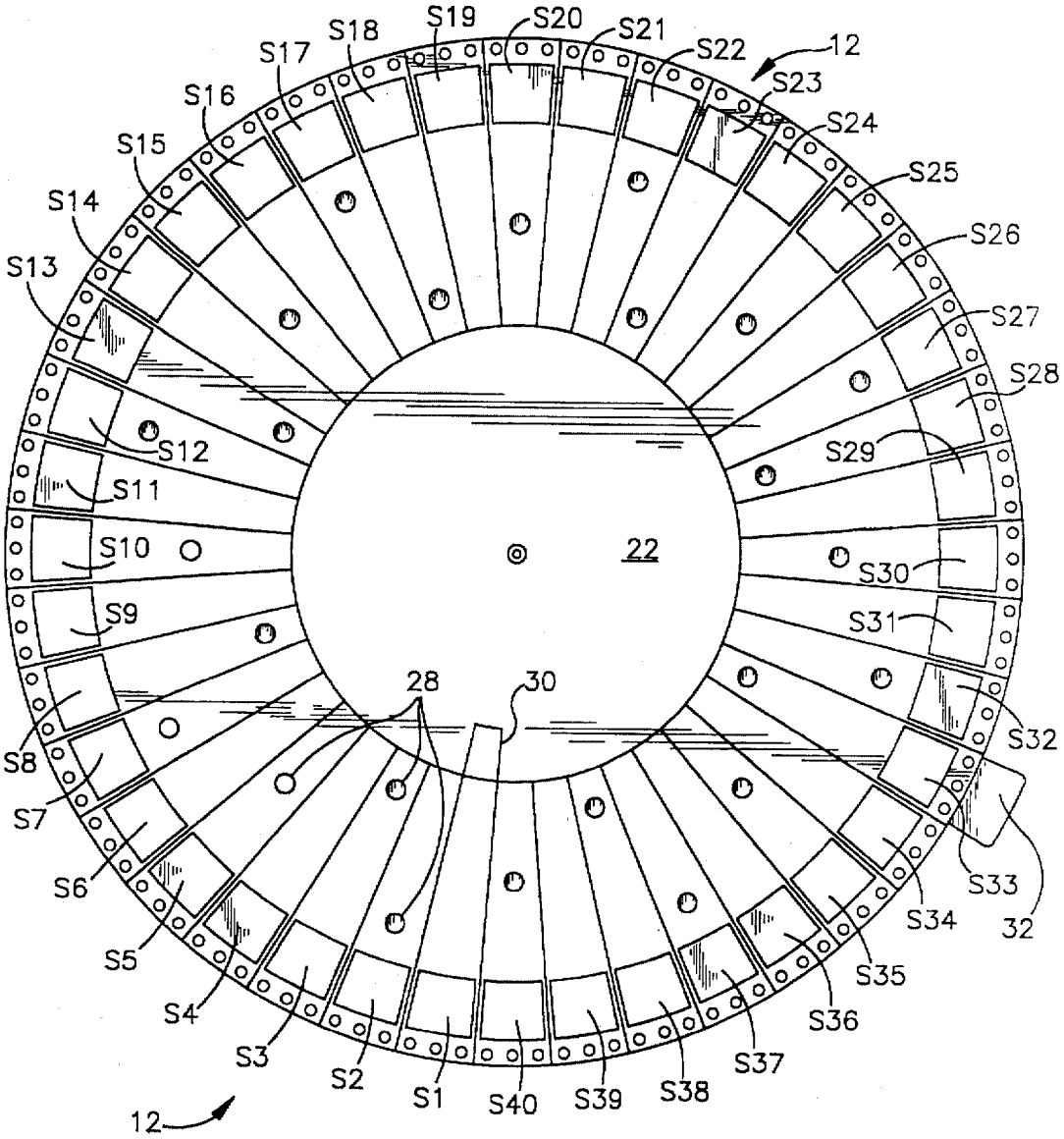
FIG. 2 is a top plan view of the game board of FIG. 1.
Figure 3:
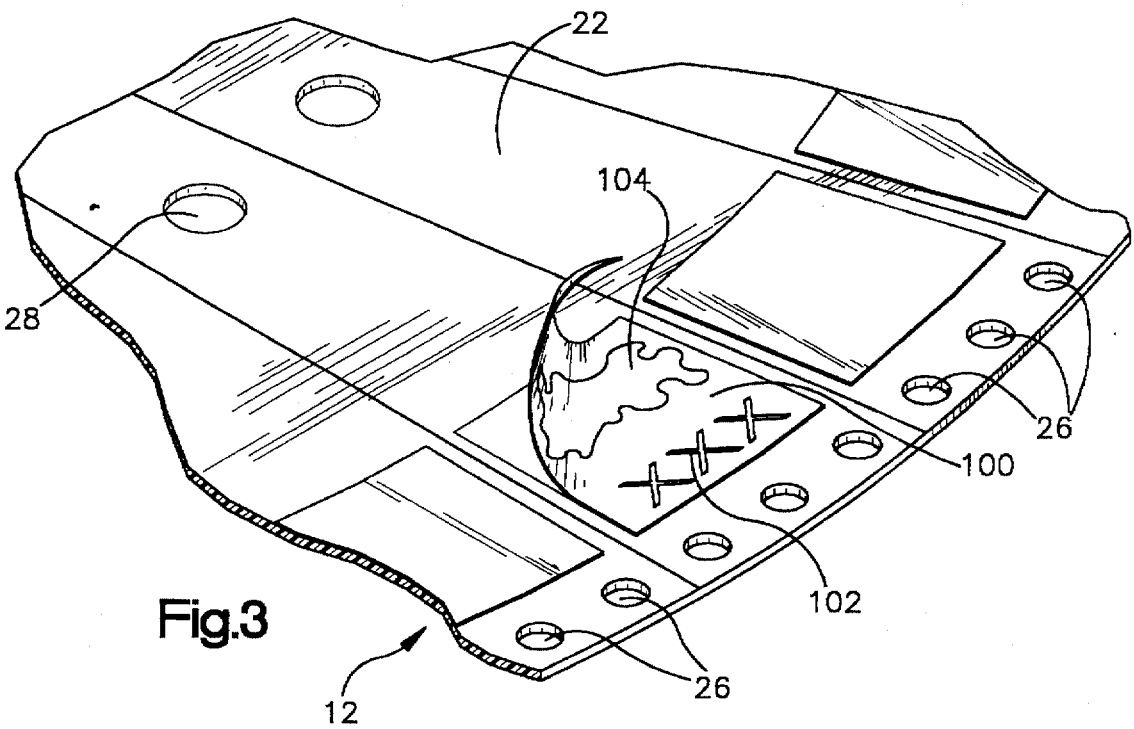
FIG. 3 is a fragmentary perspective view of a portion of the game board with a playing space designator partially peeled off an upper surface of the game board.

Spaced radially inwardly of each of the company playing spaces S2, S3, S5, S7, S8, S10, S12, S13, S15, S17, S18, S20, S22, S23, S25, S27, S28, S30, S32, S33, S35, S37, S38, S40 is a business interest price window 28 (seen in FIGS. 2 and 3). The windows 28 provide a view of the upper surface 24 of the information board 14. For each company playing space, indicia including a set of stock market prices are printed at spaced apart locations on the information board.

Five different stock market price sets are printed for each company playing space. The stock market prices correspond to five different states of the economy, namely, normal economy, recession, depression, inflation, and super inflation. Two numbers appear on each stock price indicium. A radially inner number represents the price at which one would purchase or sell stock and an outer number represents the price for an option to purchase stock. The information board 14 is formatted such that prices for stock and options for the companies increase in a clockwise direction from the playing space S1.

The economic states are also printed on the information board upper surface 24. The stock market price of the company playing space seen through the windows 28 at any time corresponds to a present state of the economy, which is visible through an economic state window 30. Stated another way, given a present economic state, the business stock market price for each company playing space for the present economic state will be visible through its respective window 28 and the present economic state will visible through the economic state window 30.

When, during the course of a game, the economic state changes, a handle 32 extending outwardly from the information board 14 beyond an outer periphery of the playing board 12 is moved to rotate the information board with respect to the playing board. The handle is moved such that the new state of the economy is visible through the economic state window 30. When the new economic state is visible through the window 30, the corresponding company stock market prices for that economic state will be visible through the window 28.

Playing Space Designators

A plurality of sets of playing space indicators 100 are provided. Two playing space designators 100 are shown in FIG. 1, one playing space designator features a hypothetical company "XXX" and the other playing space designator features a hypothetical company "YYY." The playing space designator 100 includes an upper surface having imprinted thereon a company name 102 and the company's logo 104.

A set of playing space designators 100 consists of at least 24 designators 100, that is, at least one designator for each of the 24 company playing spaces. The playing space designators 100 in any given set preferably are related, e.g., competitors in an industry or service group. For example, one set of playing space designators 100 may consist of designators featuring automobile manufacturers. Another set of playing space designators 100 may consist of designators featuring major league baseball teams. Still another set of playing space designators 100 may consist of national and regional restaurant chains.

Prior to playing a game, the players select a set of playing space designators 100. The players then select individual playing space designators 100 for each of the 24 company playing space locations. The stock market price associated with each company playing location is visible through its respective stock price window 28. Therefore, the players may assign the designators 100 to company playing locations such that the selected companies have a desired stock market value.

Assuming a set of playing space designators 100 featuring major league baseball teams is chosen by the players and the set consists of 28 designators each featuring a different one of the 28 major league baseball teams. The players would then choose 24 playing space designators corresponding to the 24 company playing spaces. The 24 designators would be assigned to company playing spaces by the players such that, for example, a favorite team or the world series champion would be assigned the playing space having the highest stock market value. Subsequent designators would be assigned company playing spaces based on the players' subjective views of what the selected teams are "worth." Thus, the game board 10 of the present invention permits the players to select what industry or teams they wish to play with and further permits the players to subjectively rank selected companies based on perceived value and assign the companies to playing spaces having stock market values congruent with the players' rankings. A playing space designator 100 has characteristics based on indicia printed on the designator surface, i.e., the company name and logo, and additionally has characteristics based on indicia, i.e., stock market values, printed in the indicator board 14 corresponding to the designator's assigned company playing space.

In the preferred embodiment, the playing space designators 100 are comprised of a flexible plastic material (FIG. 3). The playing space designators 100 are pressed on the playing board upper or playing surface 22 and remains affixed to the surface during playing of the game by surface tension. After the game is completed, the playing space designators 100 may be peeled off the playing board upper surface 22. A designator 100 partially peeled off the playing board upper surface is shown in FIG. 3.

The flexible plastic playing space designator 100 would be positioned on the playing surface 22 of the playing board 12 just inwardly of the chair peg holding apertures 26 so as not to block use of the apertures. The playing surface 22 includes outlines 106 (FIGS. 1 and 3) to aid in properly positioning the playing space designators 100 on the playing surface 22.

Figure 4:
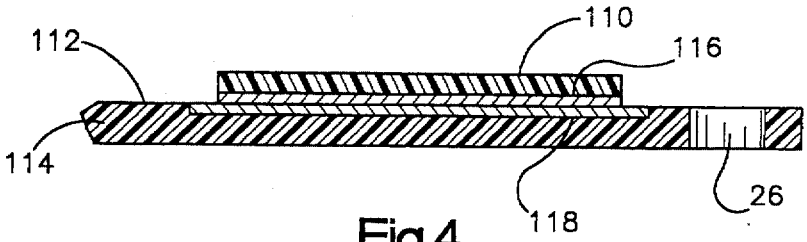
FIG. 4 is a sectional view of an alternate embodiment of a game board and an alternate embodiment of a playing space designator.

In an alternate embodiment of the present invention, magnetic forces are utilized to affix a playing space designator 110 to a playing surface 112 of a playing board 114. Turning to FIG. 4, a playing space designator 110 having a thin strip 116 of magnetic material secured to a downward facing side of the designator is maintained in place on the playing surface by magnetic attraction to a strip 118 of ferrous material positioned just under the playing surface 112.

In another embodiment of the present invention which is not shown, the thin strip 116 secured to the downward facing side of the designator 110 is comprised of ferrous material while the strip 118 under the playing surface 112 includes magnetic material. It should be appreciated that a thin annular ring (not shown) of ferrous or magnetic material may be used under the playing surface 112 in lieu of a plurality of individual, separate strips 118, one for each company playing space.

Figure 5:
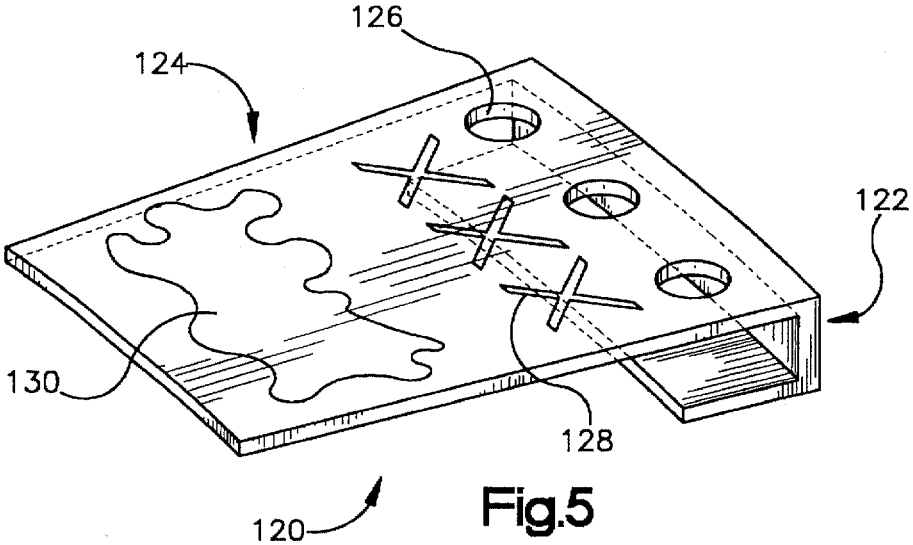
FIG. 5 is perspective view of another alternate embodiment of a playing space designator.
Figure 5A:
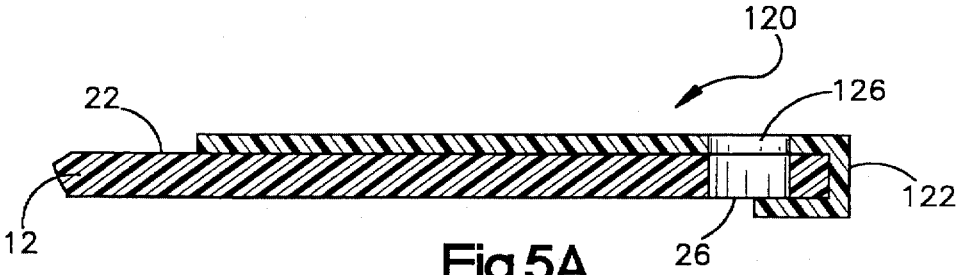
FIG. 5A is a sectional view of a portion of the game board of FIG. 1 and the playing space designator of FIG. 5.

Another embodiment of the present invention is illustrated in FIGS. 5 and 5A. In this embodiment an lipped playing space designator 120 is utilized with the playing board 12. The designator 120 is comprised of a rigid but slightly flexible material such as plastic. A lip portion 122 of the designator 120 is sized to snugly fit over the outer edge of the playing board 12. An upper portion 124 of the designator 120 includes three apertures 126 which align with the corresponding playing board apertures 26 to permit the chairs pegs to be inserted into the playing board as described above. An upper surface of the upper portion 124 of the designator includes a company name 128 and a company logo 130.

Figure 6:
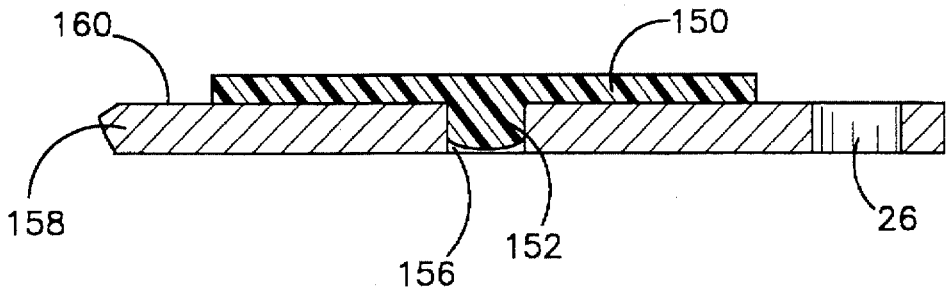
FIG. 6 is a sectional view of a portion of an alternate embodiment of a game board and an alternate embodiment of a playing space designator.
Figure 6A:
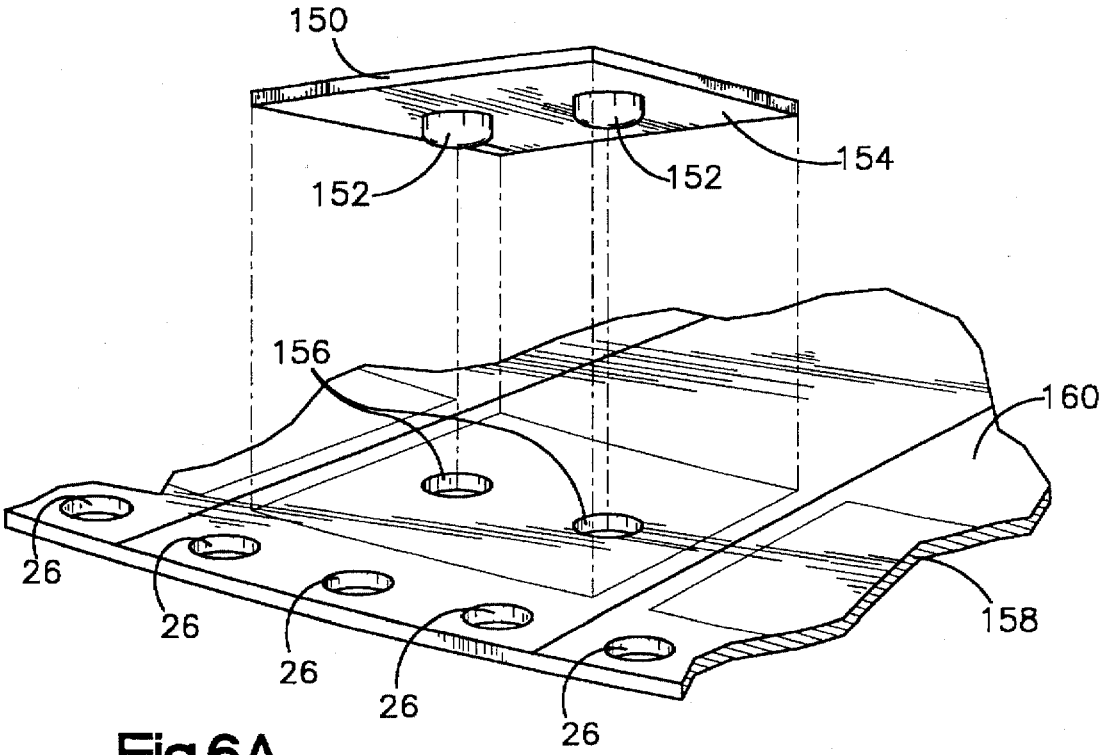
FIG. 6A is an exploded, fragmentary view of a portion of the game board of FIG. 6 and the playing space designator of FIG. 6.

Another embodiment of a game board of the present invention is illustrated in FIGS. 6 and 6A. In this embodiment, a playing space designator 150 having two pegs 152 extending from the downward facing side 154 of the designator is utilized. The pegs 152 are sized to snugly interfit in corresponding apertures 156 in a playing board 158 to secure the designator 150 to an upper surface 160 of the board.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. A game board apparatus comprising:

a) a playing game board including a playing surface marked with game indicia including a plurality of playing spaces that combine to define a path over the playing surface for traversal by game players as a game is played;

b) playing pieces for movement along the path defined by the playing spaces;

c) at least two sets of removable playing space designators each set of the at least two sets of playing space designators having a plurality of playing space designators at least equal to a number of playing spaces of the playing game board and wherein each designator comprises a generally flat flexible piece of plastic that is removably affixable to the playing surface and sized to overlie at least a portion of a selected playing space, a lower surface of each designator adhering to the playing board playing surface by surface tension; and d) each playing space designator in a set of playing space designators having a related characteristic and having imprinted thereon identifying indicia indicative of one or more distinguishing characteristics of the designator thereby distinguishing the designator from other designators in the set.

2. The game board apparatus of claim 1 wherein each of the playing space designators includes an upper surface having imprinted thereon the identifying indicia representing the one or more characteristics of the playing space designator.

* * * * *